US008540122B2

(12) United States Patent
Skillern et al.

(10) Patent No.: US 8,540,122 B2
(45) **Date of Patent: *Sep. 24, 2013**

(54) PRESSURIZED HYDRATION SYSTEM

(75) Inventors: Jeff Skillern, Boise, ID (US); James H. Sadler, Huntington, VT (US)

(73) Assignee: Oakley, Inc., Foothill Ranch, CA (US)

( * ) Notice: Subject to any disclaimer, the term of this patent is extended or adjusted under 35 U.S.C. 154(b) by 1264 days.

This patent is subject to a terminal disclaimer.

(21) Appl. No.: 12/204,326

(22) Filed: Sep. 4, 2008

(65) Prior Publication Data

US 2010/0044396 A1 Feb. 25, 2010

Related U.S. Application Data

(63) Continuation-in-part of application No. 11/764,620, filed on Jun. 18, 2007, now Pat. No. 8,136,702.

(60) Provisional application No. 60/822,273, filed on Aug. 14, 2006, provisional application No. 60/969,742, filed on Sep. 4, 2007.

(51) Int. Cl.
*B65D 37/00* (2006.01)
*B67D 7/60* (2010.01)

(52) U.S. Cl.
USPC ..... 222/209; 222/95; 222/105; 222/386.5; 222/389; 222/399; 224/148.2; 220/703; 62/457.9

(58) Field of Classification Search
USPC ..... 222/94, 95, 105, 175, 146.6, 209, 222/386.5, 389, 399, 400.5, 400.7, 400.8; 224/148.2; 220/703; 62/457.9
See application file for complete search history.

(56) References Cited

U.S. PATENT DOCUMENTS

| | | | |
|---|---|---|---|
| 3,309,890 | A | 3/1967 | Barnett et al. |
| 3,677,443 | A | 7/1972 | Smadar et al. |
| 4,420,097 | A | 12/1983 | Motsenbocker |
| 4,629,098 | A | 12/1986 | Eger |
| 4,998,415 | A | 3/1991 | Larsen |

(Continued)

OTHER PUBLICATIONS

U.S. Appl. No. 12/322,995, filed Feb. 9, 2009.

(Continued)

*Primary Examiner* — Kevin P Shaver
*Assistant Examiner* — Melvin Cartagena
(74) *Attorney, Agent, or Firm* — Knobbe Martens Olson & Bear LLP

(57) ABSTRACT

A hydration system includes first and second opposing flexible walls that form a bladder having a sealable compartment for containing a liquid. The system includes a drinking tube having a first end with a valve and a second end. A first port is configured to receive pressurizing gasses into the compartment. A second port is configured to provide fluid communication between the compartment and the drinking tube. The third port allows liquid to be supplied into the compartment. A first baffle and a second baffle connect the opposing walls within the compartment. The first and second baffles are configured to oppose expansion of the bladder as the pressurizing gasses are introduced into the compartment. A space between the first and second baffles is accessible via the third port. The space is configured to receive and secure a thermal pack. The thermal pack is insertable and removable via the third port. When sealed and pressurized, activation of the valve unseals the compartment and allows the liquid to be expelled from the compartment via the second port and the drinking tube as a result of a pressurization of the compartment by the pressurizing gasses.

15 Claims, 15 Drawing Sheets

(56) References Cited

U.S. PATENT DOCUMENTS

| | | | | |
|---|---|---|---|---|
| 5,062,591 | A | 11/1991 | Runkel | |
| 5,282,557 | A | 2/1994 | McCook | |
| 5,447,039 | A | 9/1995 | Allison | |
| 5,699,933 | A | 12/1997 | Ho et al. | |
| 5,911,406 | A | 6/1999 | Winefordner et al. | |
| 5,913,456 | A | 6/1999 | Dikeman | |
| 5,940,880 | A | 8/1999 | Phillips | |
| 6,039,305 | A | 3/2000 | Hoskins et al. | |
| 6,581,538 | B2 | 6/2003 | Sorensen | |
| 7,806,300 | B1 * | 10/2010 | Noell et al. | 222/175 |
| 2002/0166493 | A1 | 11/2002 | Sorensen | |
| 2006/0144862 | A1 | 7/2006 | Reichert et al. | |
| 2006/0144863 | A1 | 7/2006 | Reichert et al. | |
| 2007/0164037 | A1 | 7/2007 | Chen | |
| 2008/0029561 | A1 | 2/2008 | Reichert et al. | |
| 2008/0308032 | A1 | 12/2008 | Skillern | |
| 2008/0308578 | A1 | 12/2008 | Skillern et al. | |
| 2009/0140005 | A1 | 6/2009 | Reichert et al. | |
| 2009/0179046 | A1 | 7/2009 | Reichert et al. | |
| 2009/0302261 | A1 | 12/2009 | Skillern | |

OTHER PUBLICATIONS

U.S. Appl. No. 60/987,741 and cover sheet, filed Nov. 13, 2007 by Reichert et al., entitled "Pressurized Fluid Delivery System With Filter and Associated Method," in 24 pages.

International Search Report of Oct. 1, 2009 in International Application No. PCT/US2009/053784 filed on Aug. 13, 2009 from the International Searching Authority 8 pages.

* cited by examiner

PRESSURIZED HYDRATION SYSTEM

CROSS REFERENCE TO RELATED APPLICATION

This application is a continuation in part of U.S. patent application Ser. No. 11/764,620 filed Jun. 18, 2007 now U.S. Pat. No. 8,136,702 (now published as U.S. Patent Application Publication No. 2008-0308578 A1 to Skillern et al.) having the same title, and incorporated herein by reference in its entirety, which claims the benefit of U.S. provisional patent application 60/822,273, filed Aug. 14, 2006. The present application also claims the priority of U.S. provisional patent application No. 60/969,742 filed Sep. 4, 2007.

BACKGROUND

Personal hydrations systems help athletes maintain adequate hydration while engaging in strenuous physical activities, such as running, cycling, skiing, hiking, or mountain climbing. These personal hydration systems typically include a bag-like reservoir carried in a back pack or waist pack. A flexible drinking tube connects to the reservoir through an exit port at one end and terminates in a mouthpiece at the other end. The tube is long enough to allow the mouthpiece to be carried in the user's mouth to enable the user to draw water from the reservoir like sucking water through a straw. When low on breath during vigorous exercise, drawing water from the reservoir can prove to be a difficult task.

DESCRIPTION OF THE DRAWINGS

FIG. 1. is a top plan view, while FIG. 2 is a side elevation view.

FIGS. 3-7B illustrate a pressurized hydration system. FIG. 3 is a top plan view. FIGS. 4 and 5 are partial exploded views. FIG. 6 illustrates a reservoir being filled with a liquid. FIGS. 7A and 7B are partial cross sectional views showing baffles.

DETAILED DESCRIPTION

Introduction: Various embodiments of the present invention assist in expelling liquid from a personal hydration system. The following description is broken into sections. The first provides an example of a conventional hydration system. The second section provides an example of a pressurized hydration system. The third section describes a remote pressurized hydration system. The fourth section describes various balloon pressurized hydration systems. The fifth section discusses manual pressurization, and the last section describes a self-cooling pressurized hydration system.

In the various examples discussed below, the term reservoir is used. While the figures show specific examples of bag like reservoirs, other types of containers such as sports bottles and the like are encompassed by the term reservoir. In short, the term reservoir refers to any object in which a drinking fluid can be sealed.

Figure 1:
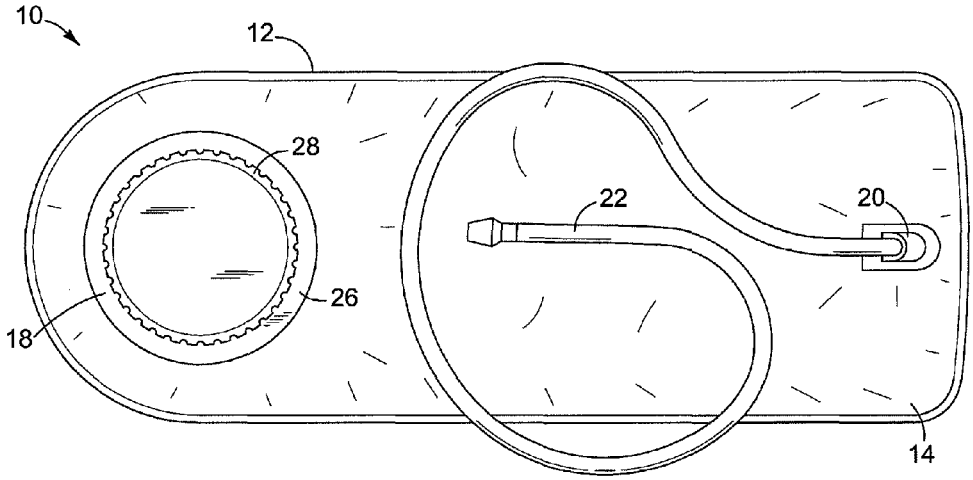
FIG. 1 (Prior Art)
FIGS. 1 and 2 illustrates an exemplary a personal hydration system in the form of a reservoir.
Figure 2:
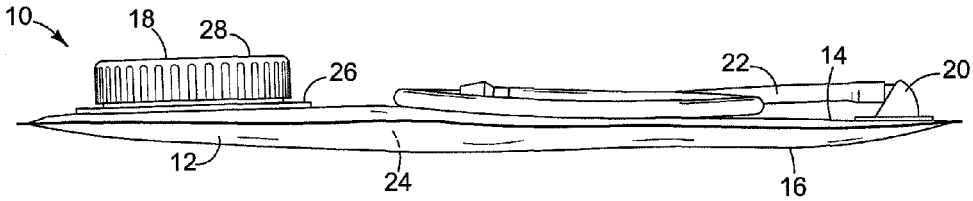
FIG. 2 (Prior Art)
Figure 3:
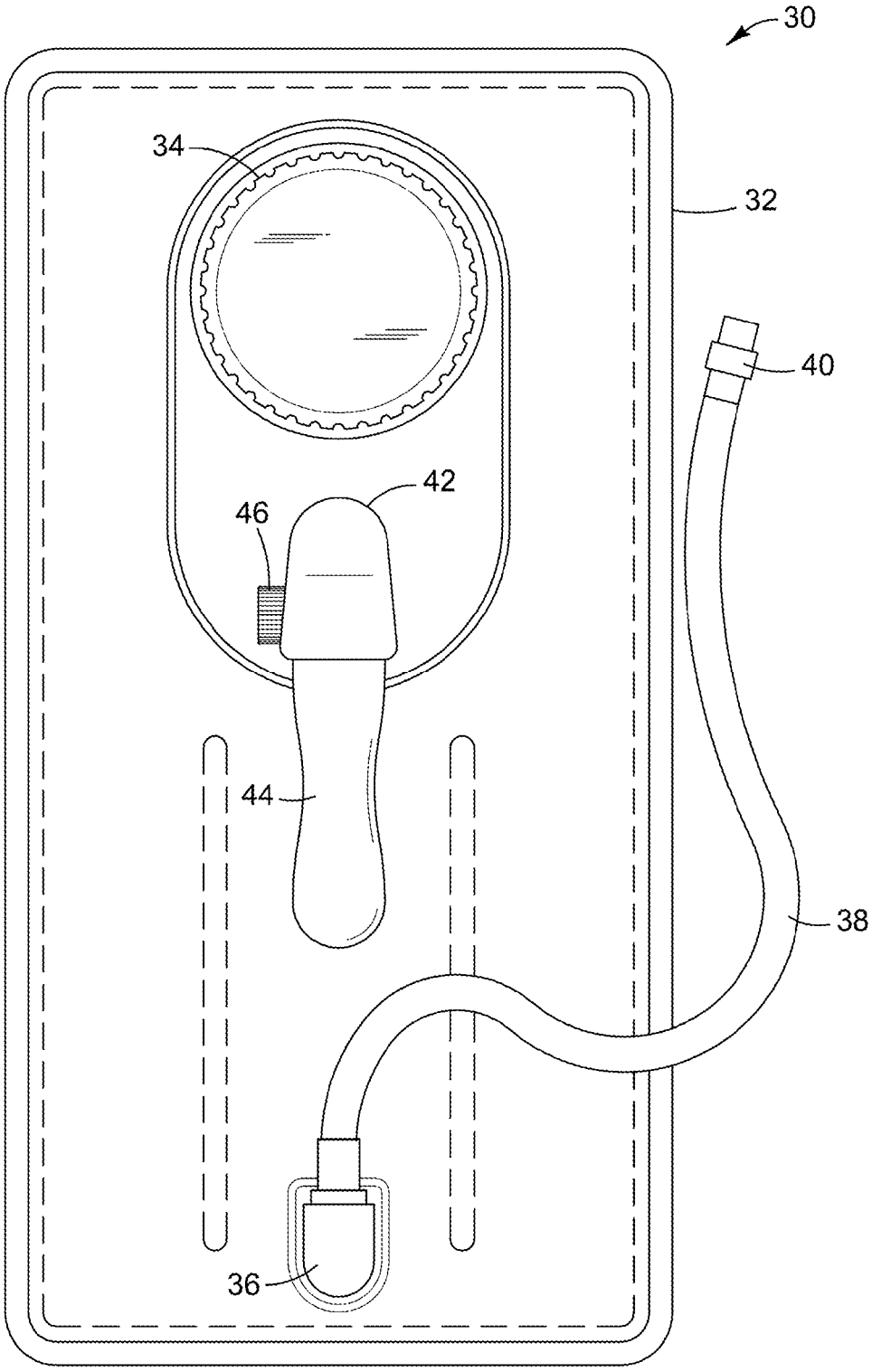

Non-Pressurized Hydration System: FIGS. 1 and 2 illustrate an exemplary hydration system in the form of reservoir 10. Reservoir 10 includes bladder 12 formed by opposing walls 14 and 16 (seen best in FIG. 20), fill port 18, exit port 20, and drinking tube 22. Walls 14 and 16 form an internal compartment 24 adapted to store a volume of fluid such as water. Walls 14 and 16 can be formed from a flexible, waterproof material. An example of a suitable material is polyurethane, although others may be used. The size and shape of compartment 24 may vary, such as depending upon the desired application with which the system will be used, any pack into which reservoir 10 will be placed, the mechanism by which the reservoir 10 will be transported, and the volume of drink fluid that compartment 24 is designed to hold.

The length of drinking tube 22 may vary depending upon the desired distance between the user's mouth and the location where reservoir 10 is positioned, such as on a user's back, waist, inside a user's garments, on a user's bike or other equipment. An end of drinking tube 22 is connected to reservoir 10 at exit port 20 through which fluid in compartment 24 is received into tube 22. In other words, compartment 24 is in fluid communication with exit port 20.

Reservoir 10 includes fill port 18 through which fluid may be poured into or removed from compartment 24. Fill port 18 also provides an opening through which compartment 24 may be accessed for cleaning. As shown, fill port 18 includes collar 26 and cap 28. Collar 26 is sealed to wall 14. Cap 28 is removably sealed to collar 26. For example, collar 26 and cap 28 may include mating threads and a gasket allowing cap 28 to be twisted off to be separated from collar 26 and twisted on to be sealed to collar 26. With cap 28 removed, a fluid can be poured into compartment 24 through collar 26 of fill port 18. Cap 28 can then be sealed to collar 26 securing the fluid in compartment 24. User supplied suction applied to drinking tube 22 can then pull the fluid out of compartment 24 through exit port 20.

Pressurized Hydration System: FIGS. 3-7B illustrate an exemplary pressurized hydration system in the form of reservoir 30. In this example, reservoir 30 includes bladder 32 formed by opposing walls 50 and 52 (seen best in FIGS. 7A and 7B), fill port 34, exit port 36, drinking tube 38, and bite valve 40. Walls 50 and 52 form an internal sealable compartment 54 (seen best in FIGS. 7A and 7B) adapted to store a volume of fluid such as water. Walls 50 and 52 can be formed from a flexible, waterproof material. An example of a suitable material is polyurethane, although others may be used. The size and shape of compartment 54 may vary, such as depending upon the desired application with which the system will be used, any pack into which reservoir 30 will be placed, the mechanism by which the reservoir 30 will be transported, and the volume of drink fluid that compartment 54 is designed to hold.

The length of drinking tube 38 may vary depending upon the desired distance between the user's mouth and the location where reservoir 30 is positioned, such as on a user's back, waist, inside a user's garments, on a user's bike or other equipment. An end of drinking tube 38 is connected to reservoir 30 at exit port 36 through which fluid in compartment 54 is received into tube 38. In other words, compartment 54 is in fluid communication with exit port 36.

Reservoir 30 includes fill port 34 through which fluid may be poured into or removed from compartment 54. Reservoir 30 includes pressure port 42 and pressure regulator 46. Pressure port 42 represents an inlet through which a pressurizing gas can enter into compartment 54. Pressurizing gasses can be provided via a pressurizer such as cartridge holder 44 and cartridge 48 (best seen in FIGS. 5 and 6). Cartridge holder 44 is configured to hold and cause cartridge 48 to mate with pressure port 42 in such a manner that pressurizing gas is allowed to expel from cartridge 48 and enter compartment 54. Pressure regulator 46 functions to regulate the level at which internal compartment is pressurized. Pressure regulator 46 may also function as a manual on/off switch and may regulate a rate at which pressurizing gas is allowed to escape cartridge 48 and enter compartment 54.

Once compartment 54 is filled with a liquid and pressurized, activation of bite valve results in the liquid being forced out of compartment 54 through drinking tube 38 and into a person's mouth. In this manner the person utilizing the reservoir 30 need only bite on bite valve 40 and liquid is expelled. The person need not suck to draw liquid from compartment 54.

Figure 4:
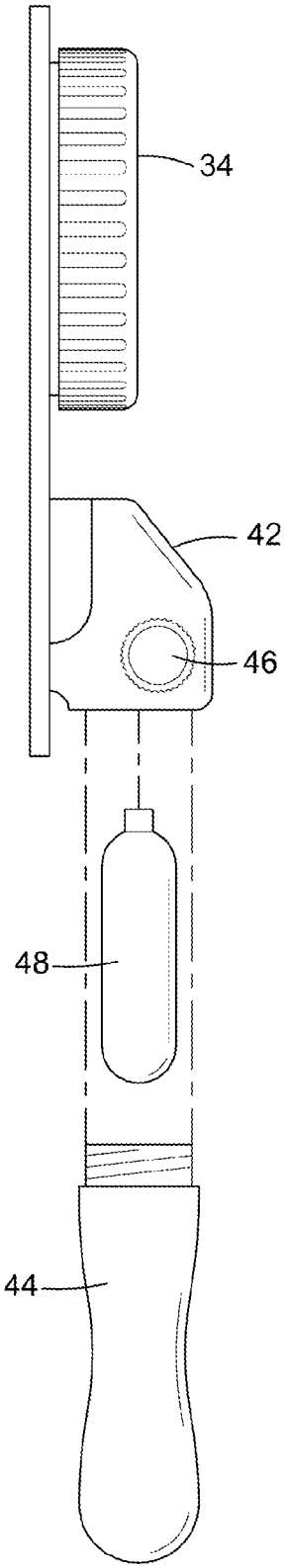
Figure 5:
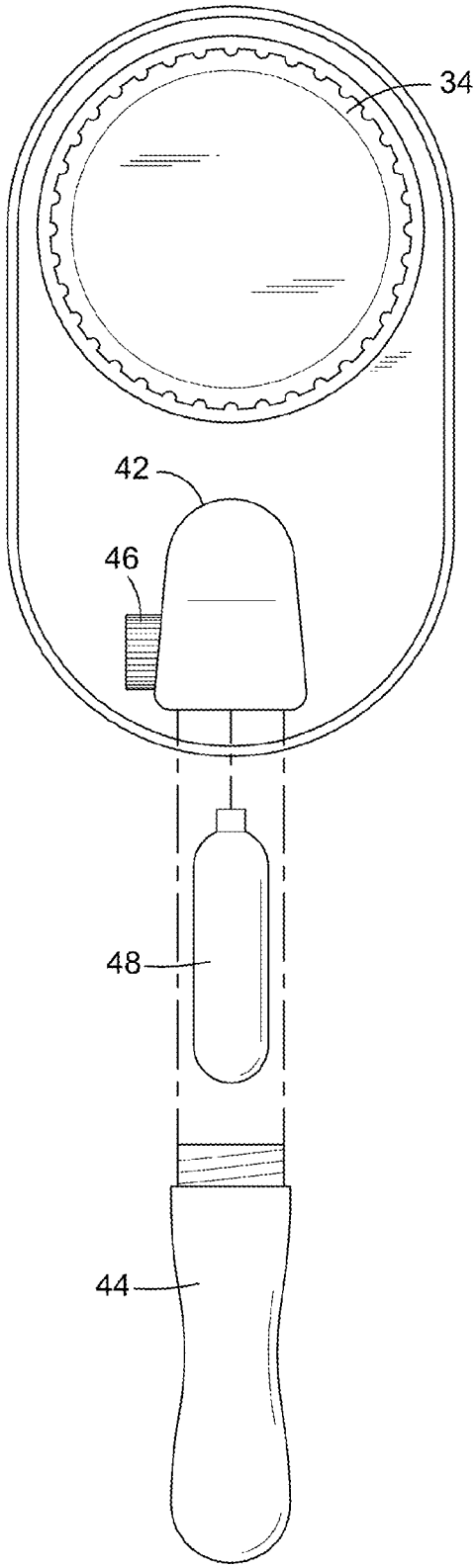

Focusing on FIGS. 4 and 5, cartridge 48 is shown to fit inside cartridge holder 44. Cartridge holder 44 threads into pressure port 42 causing cartridge 48 to engage pressure port 52 allowing pressurizing gas to be expelled from cartridge 48 through pressure port 42 and into compartment 54.

It is noted that fill port 34, exit port 36, and pressure port 42 are shown as being formed in wall 50 such that fill port 34 provides ingress for liquid into compartment 54. Likewise, pressure port 42 provides ingress for pressurizing gases into compartment 54, and exit port 36 provides an egress for liquid out of compartment 54. While show as being formed in wall 50, one or more of ports 34, 36, and 42 may be formed in wall 52 or elsewhere so long as they provide the noted ingress and egress functions. Furthermore, two or more of ports 34, 36, and 42 may be the same port.

Figure 6:
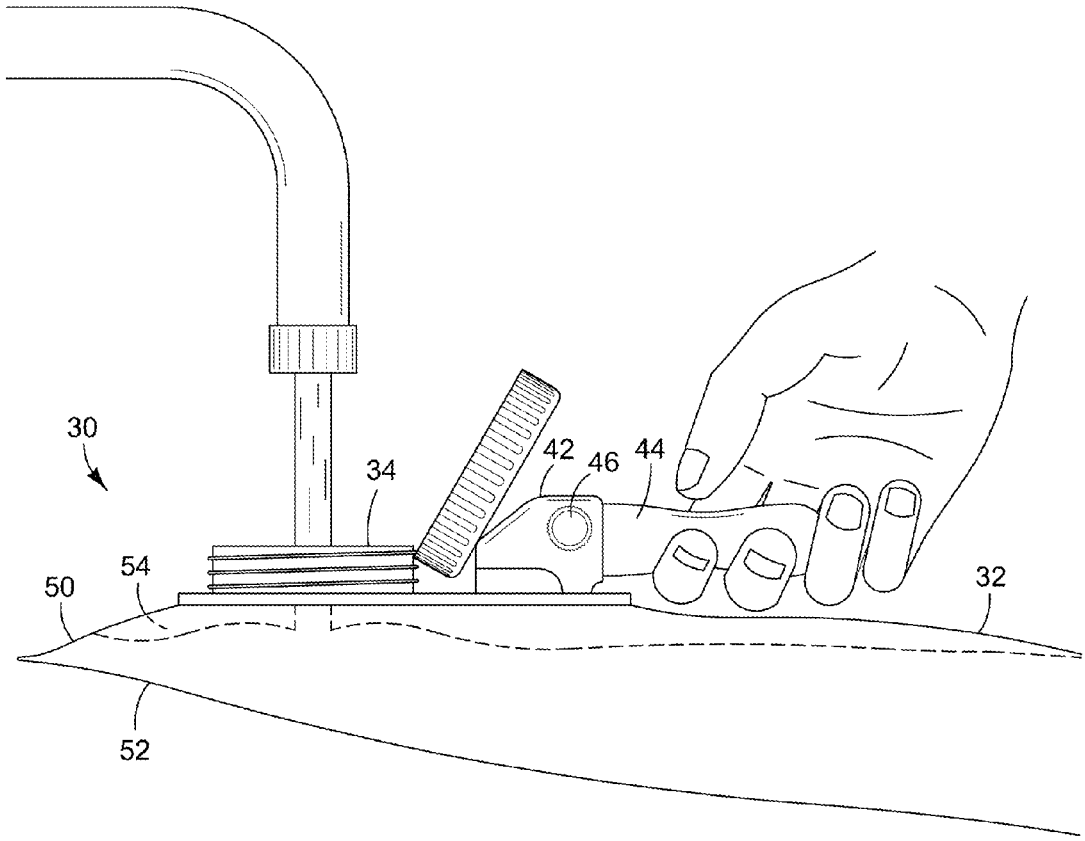

In FIG. 6, it is shown that cartridge holder 44 can also function as a handle when filling reservoir 32.

Figure 7A:
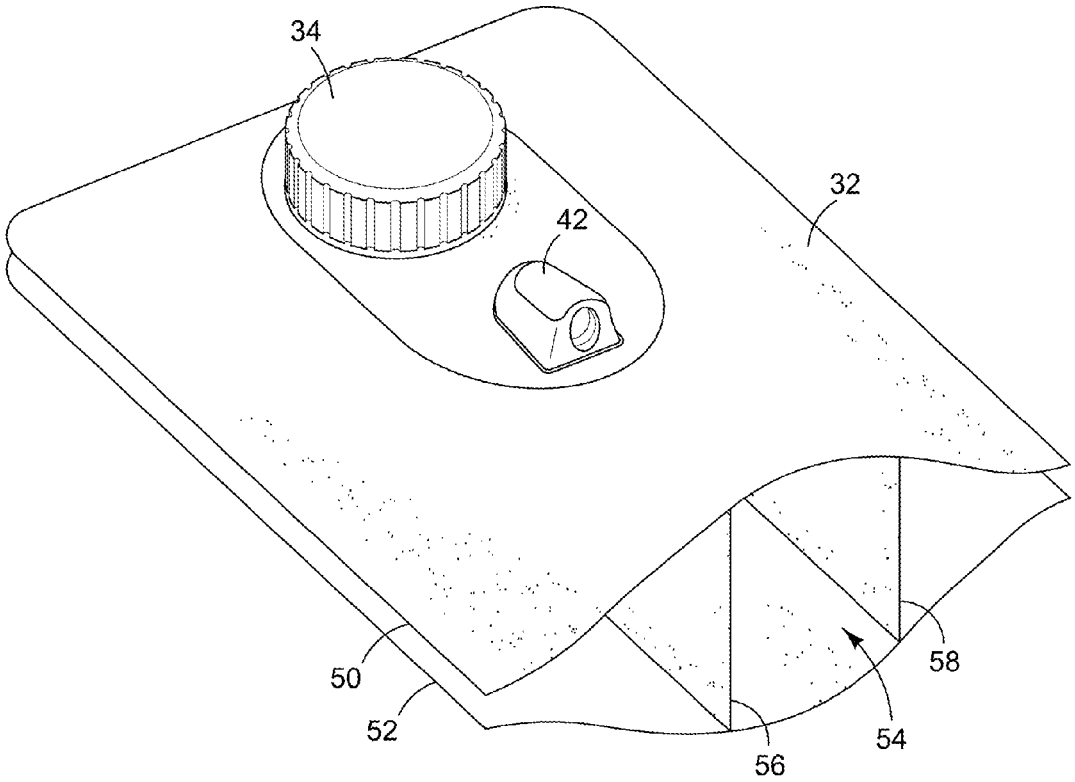

Baffles: Moving to FIG. 7A, bladder 32 is shown to include baffles 56 and 58 that connect wall 50 to wall 52 within compartment 54. Baffles 56 and 58 may be constructed from the same or different material than walls 50 and 52. As compartment 54 is pressurized, it tends to expand separating walls 50 and 52 and increasing in volume as walls 50 and 52 stretch apart. Baffles 56 and 58 operate to oppose expansion or "footballing" of walls 50 and 52 as pressurizing gasses are introduced into compartment 54. In other words, baffles 56 and 58 help keep compartment 54 at a more consistent volume as pressurizing gasses are introduced. Baffles 56 and 58 allow for a higher pressure per unit volume for compartment. While shown in a lengthwise orientation with respect to walls 50 and 52, baffles 56 and 58 can be in any orientation with respect to walls 50 and 52 so long as baffles 56 and 58 remain able to oppose the expansion of walls 50 and 52 as pressurizing gasses are introduced. Furthermore, while FIG. 7A shows bladder 32 having two baffles 56 and 58, bladder 32 may have any number of baffles.

Figure 7B:
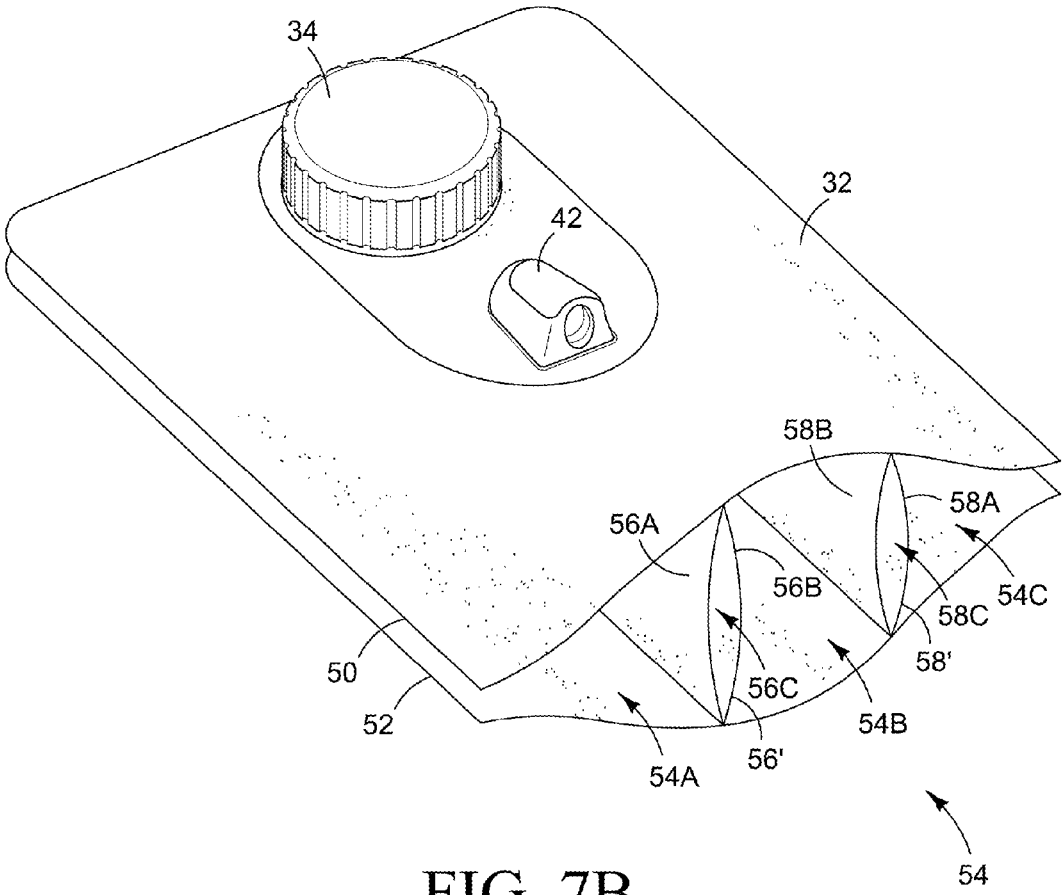

Looking at FIG. 7B, reservoir 32 includes baffles 56' and 58'. Baffle 56' includes opposing panels 56A and 52B while baffle 58' includes opposing panels 58A and 58B. Panels 56A and 56B connect wall 50 to wall 52 within compartment 54 in such manner as to form a sealed baffle pocket 56C between panels 56A and 56B. Panels 58A and 58B connect wall 50 to wall 52 within compartment 54 in such manner as to form a sealed baffle pocket 58C between panels 58A and 58B. Baffle pockets 56C and 58C can be filled with a cooling and/or heating medium or a medium suitable for either application. Any such medium may be referred to as a thermal capacitance medium. The thermal capacitance medium may be water, a gel or another material, which can be repeatedly chilled and/or heated. Once its temperature is altered, the thermal capacitance medium effectively maintains fluid within compartment 54 at a depressed or an elevated temperature for some time.

In the Example of FIG. 7B, compartment 54 can be viewed in three sections 54A, 54B, and 54C. Panel 56A forms an interior wall of section 54A. The thermal capacitance medium contained in baffle pocket 56C helps to heat or cool liquid found in section 54A. Panels 56B and 58B forms interior walls of section 54BA. The thermal capacitance medium contained in baffle pockets 56C and 58C help to heat or cool liquid found in section 54B. Panel 58A forms an interior wall of section 54C. The thermal capacitance medium contained in baffle pocket 58C helps to heat or cool liquid found in section 54C. Because the surface areas of panels 56A, 56B, 58A, and 58B are exposed mainly to the interior of reservoir 32—that is—within compartment 54, the thermal capacitance medium held in baffle pockets 56C and 58C can more effectively heat or cool liquid found in compartment 54.

Figure 8:
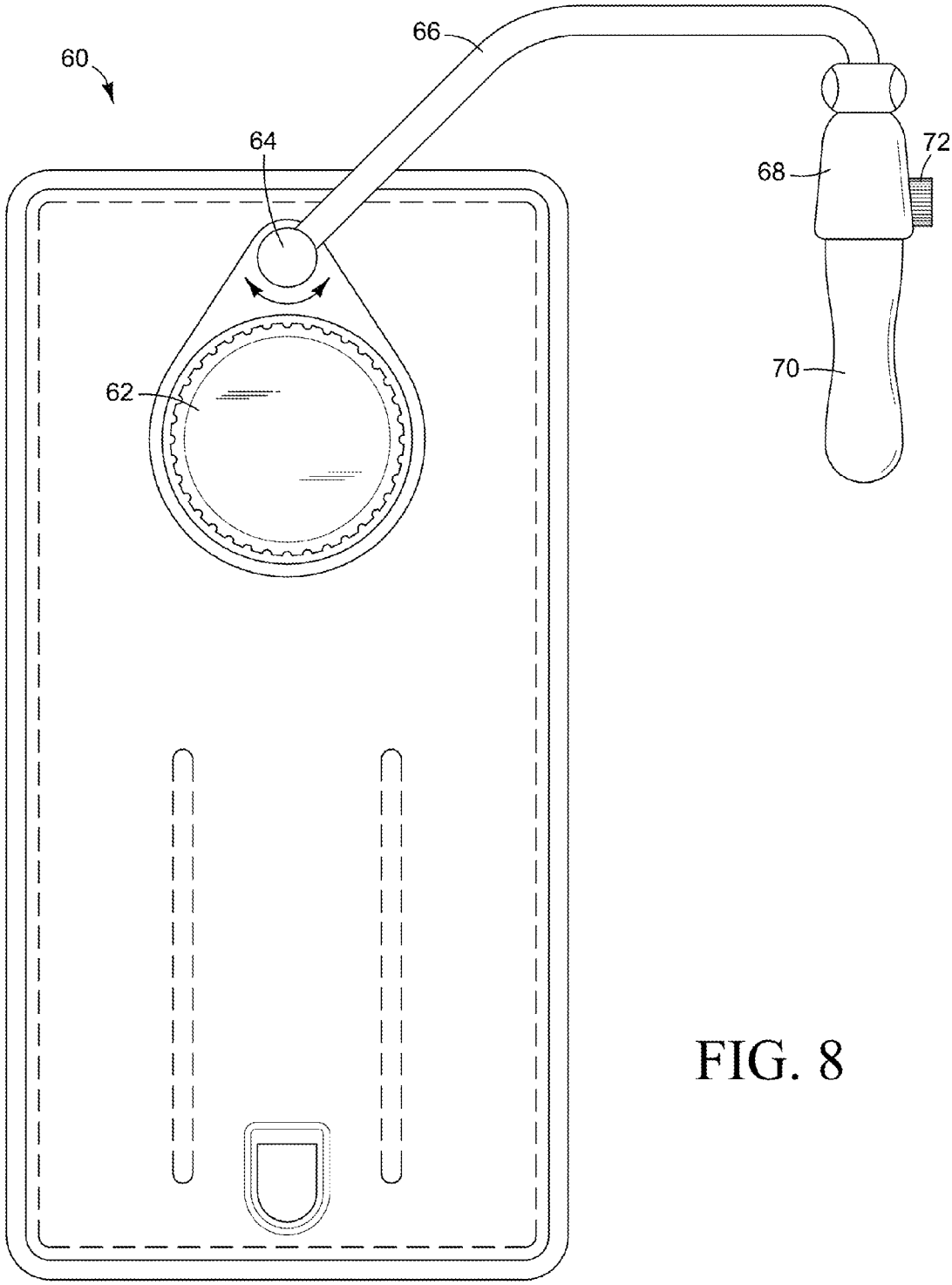
FIG. 8 illustrates a remote pressurized hydration system.

Remote Pressurized Hydration System: FIG. 8 illustrates an exemplary remote pressurized hydration system in the form of reservoir 60. Reservoir 60 includes fill port 62, swivel port 64, transfer tube 66, pressure port 68, cartridge holder 70, and pressure regulator 72. Swivel port 64 serves to provide an input for pressurizing gas into reservoir 60 via transfer tube 66. As its name suggests swivel port 64 swivels allowing transfer tube 66 to rotate about a point. While not shown, swivel port 64 may be integrated into fill port 62. For example, fill port 62 is shown to include a cap that closes fill port 62. Swivel port 64 could be formed in that cap such that when fill port 62 is closed, swivel port 64 would provide input for pressurizing gases through the cap and into reservoir 60.

Transfer tube 66 couples pressure port 68 to swivel port 64 and serves as a sealed transfer allowing pressurizing gas to pass from pressure port 68 through swivel port 64, and into reservoir 60. Pressure port 68 represents an inlet through which a pressurizing gas can ultimately be introduced into reservoir 60. Pressurizing gases can be provided via a cartridge such as cartridge 48 seen in FIGS. 5 and 6. Cartridge holder 70 is configured to hold a cartridge allowing it to mate with pressure port 68 in such a manner that pressurizing gas is allowed to exit the cartridge and enter reservoir 60 via transfer tube 66 and swivel port 64. Pressure regulator 72 functions to regulate the level at which reservoir 60 is pressurized. Pressure regulator 72 may also function as a manual on/off switch and may regulate a rate at which pressurizing gas is allowed to escape a cartridge.

A length of transfer tube 66 is selected to allow for convenient access to pressure port 68 and regulator 72. For example pressure port 68 may be attached to or integrated within a shoulder strap of a backpack used to carry reservoir 60. In this manner, a person can more easily access pressure port 68 and regulator 72 while wearing that backpack.

Balloon Pressurized Hydration System: In the Examples of FIGS. 3-7B, bladder 32 included an internal compartment 54 for containing a liquid. The bladder 32 is pressurized by introducing pressurizing gas into compartment 54 along with the liquid. FIGS. 9-12 illustrate another embodiment in which pressurizing gas is introduced into a balloon fitted within a reservoir. Expansion of that balloon pressurizes the reservoir.

Figure 9:
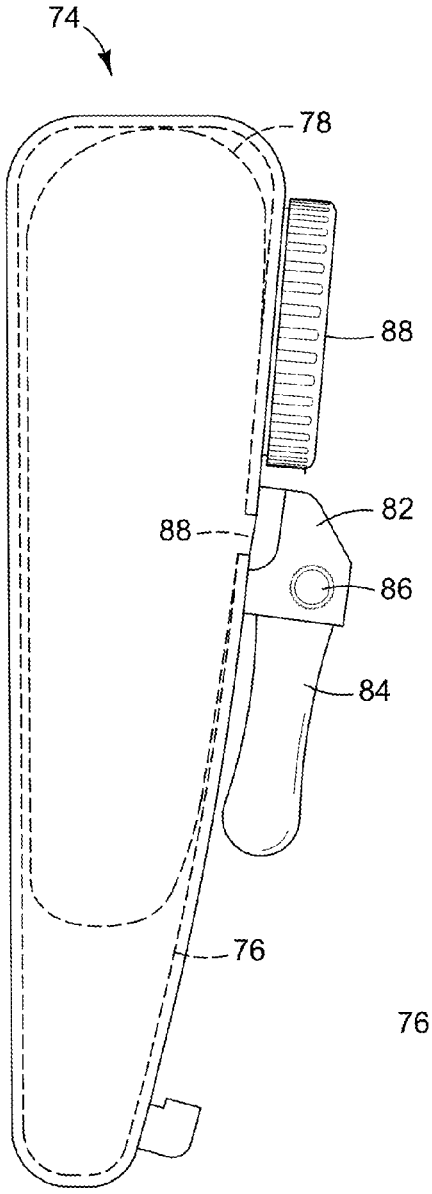
FIGS. 9-12 illustrate balloon pressurized hydration systems.
Figure 10:
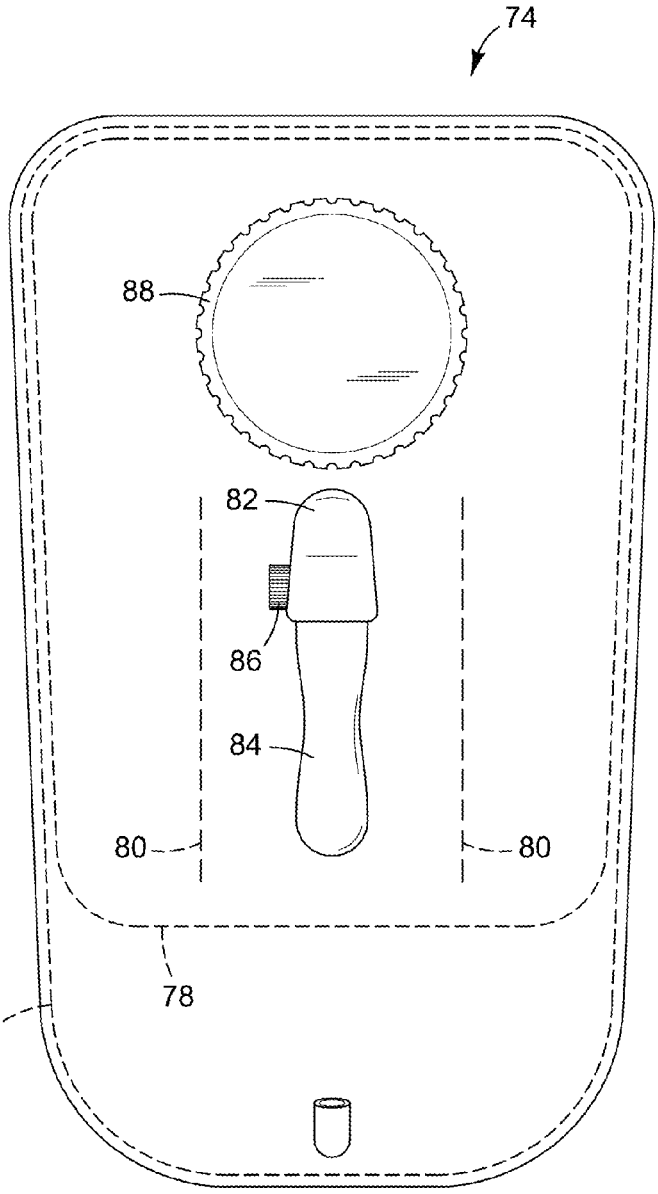

Starting with FIGS. 9 and 10, reservoir 74 includes bladder 76 defining an internal compartment for containing a liquid. Balloon 78 is fitted within that internal compartment with the liquid. Reservoir 74 includes support members 80 designed to help prevent reservoir 78 from "footballing" or over expanding as balloon 78 is pressurized. Reservoir 74 also includes pressure port 82 and pressure regulator 86. Pressure port 82 represents an inlet through which a pressurizing gas can enter into balloon 78 through passage 88. Pressurizing gases can be provided via a cartridge such as cartridge 48 seen in FIGS. 5 and 6. A cartridge holder 84 is configured to hold and cause the cartridge to mate with pressure port 82 in such a manner that pressurizing gas is allowed to exit the cartridge 48 and enter balloon 78. Pressure regulator 86 functions to regulate the level at which balloon 78 is pressurized. Pressure regulator 86 may also function as a manual on/off switch and may regulate a rate at which pressurizing gas is allowed to escape a cartridge and enter balloon 78. Introduction of pressurizing gas causes balloon 78 to expand pressurizing bladder 76.

Figure 11:
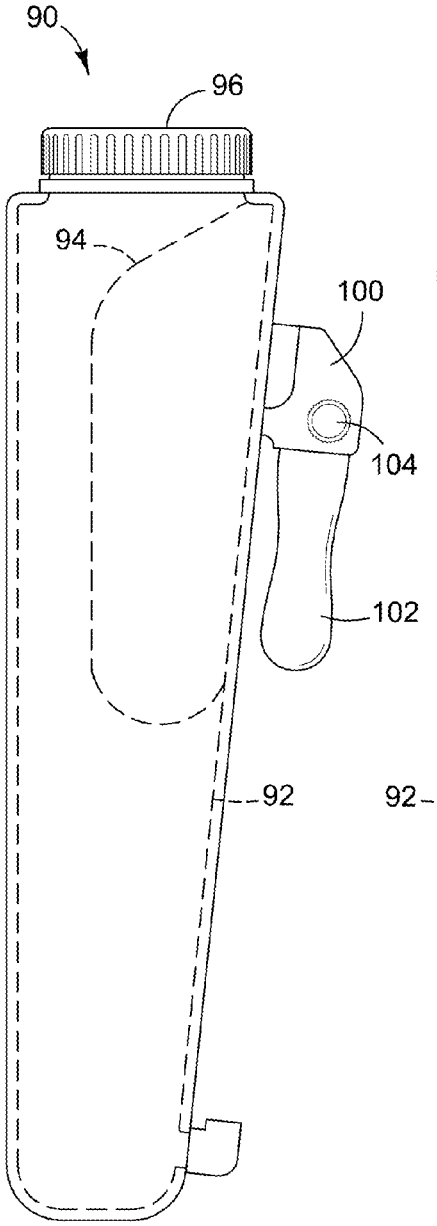
Figure 12:
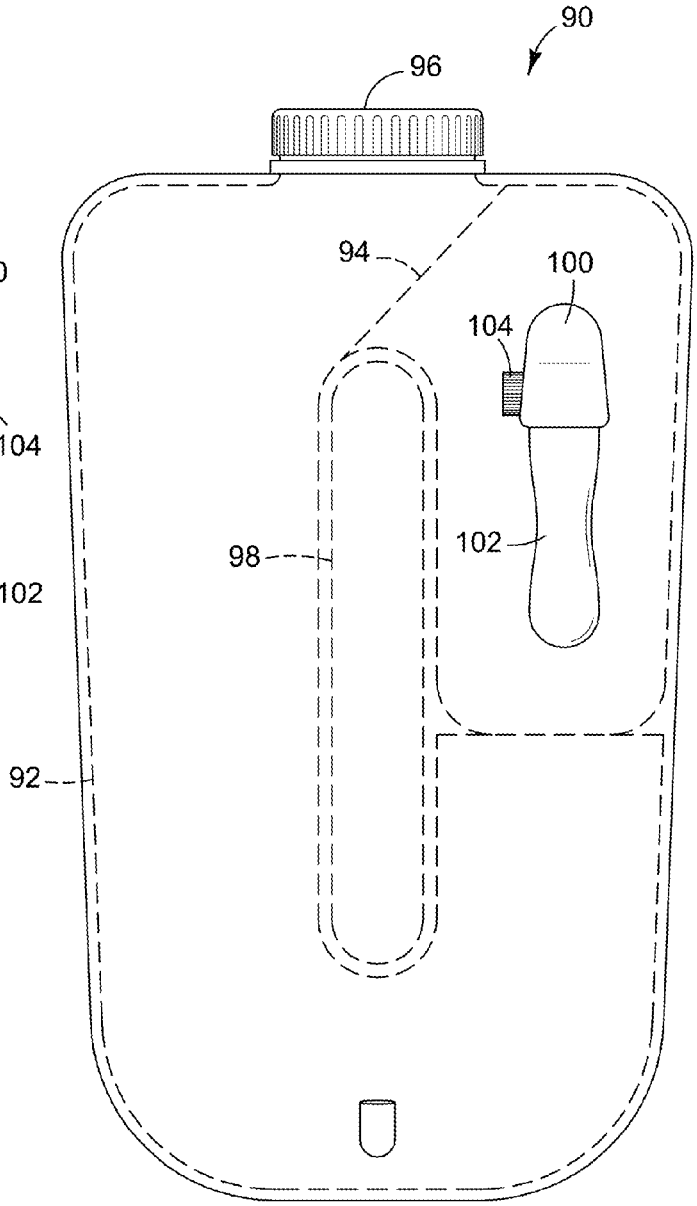

Moving to FIGS. 11 and 12, reservoir 90 includes bladder 92 into which balloon 94 is fitted. Reservoir 90 includes a top located entry port 96 through which liquid can be introduced into an internal compartment of bladder 92. Reservoir 90 includes central support member 98 designed to help prevent reservoir 90 from "footballing" or over expanding as balloon 94 is pressurized. Reservoir 90 also includes pressure port 100 and pressure regulator 104. Pressure port 100 represents an inlet through which a pressurizing gas can enter into balloon 94. Pressurizing gases can be provided via a cartridge such as cartridge 48 seen in FIGS. 5 and 6. A cartridge holder 102 is configured to hold and cause the cartridge to mate with pressure port 100 in such a manner that pressurizing gas is allowed to exit the cartridge and enter balloon 94. Pressure regulator 104 functions to regulate the level at which balloon 94 is pressurized. Pressure regulator 104 may also function as a manual on/off switch and may regulate a rate at which pressurizing gas is allowed to escape a cartridge and enter balloon 94. Introduction of pressurizing gas causes balloon 94 to expand pressurizing bladder 92.

Figure 13:
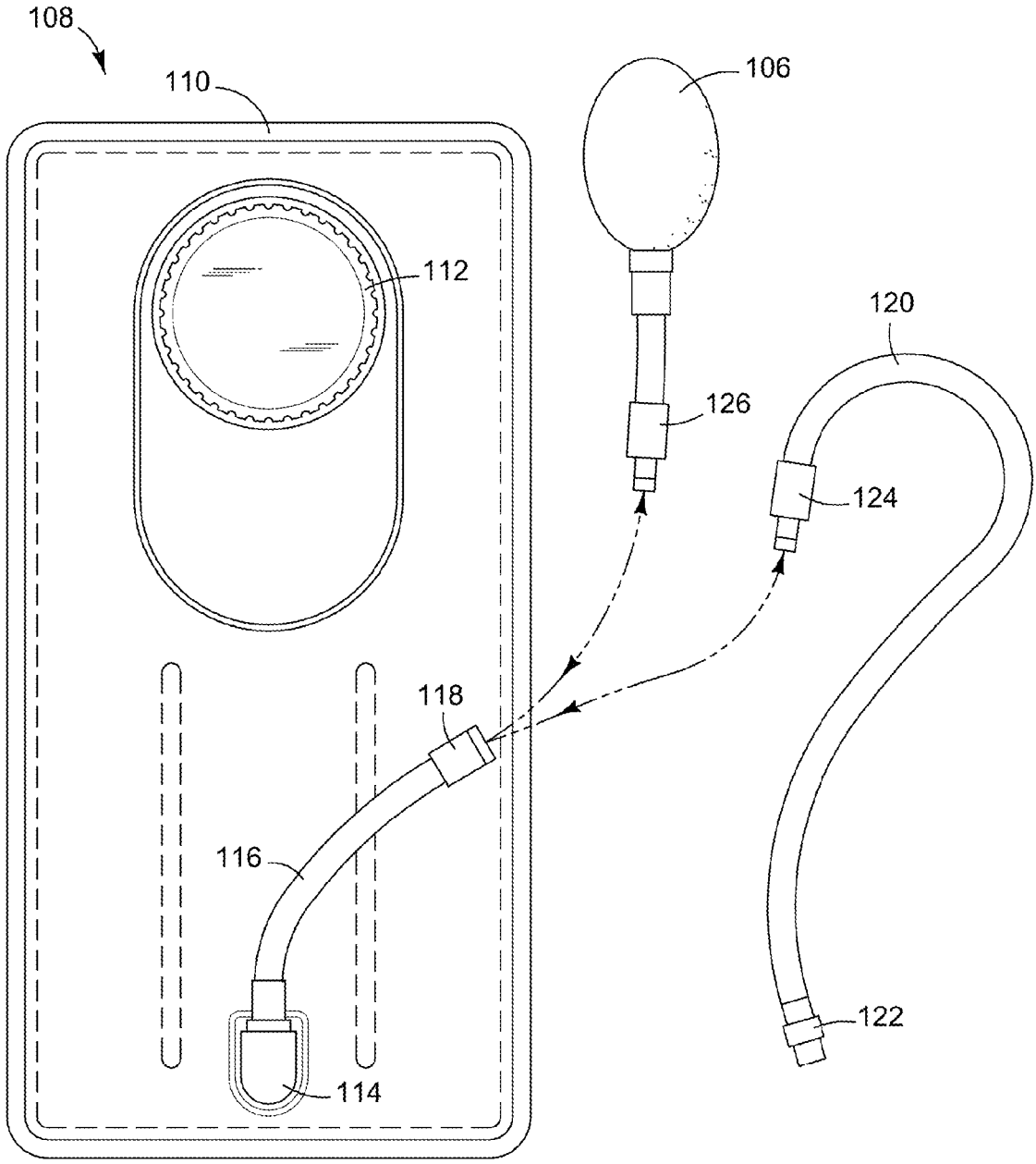
FIGS. 13-14 illustrate manually pressurized hydration systems.
Figure 14:
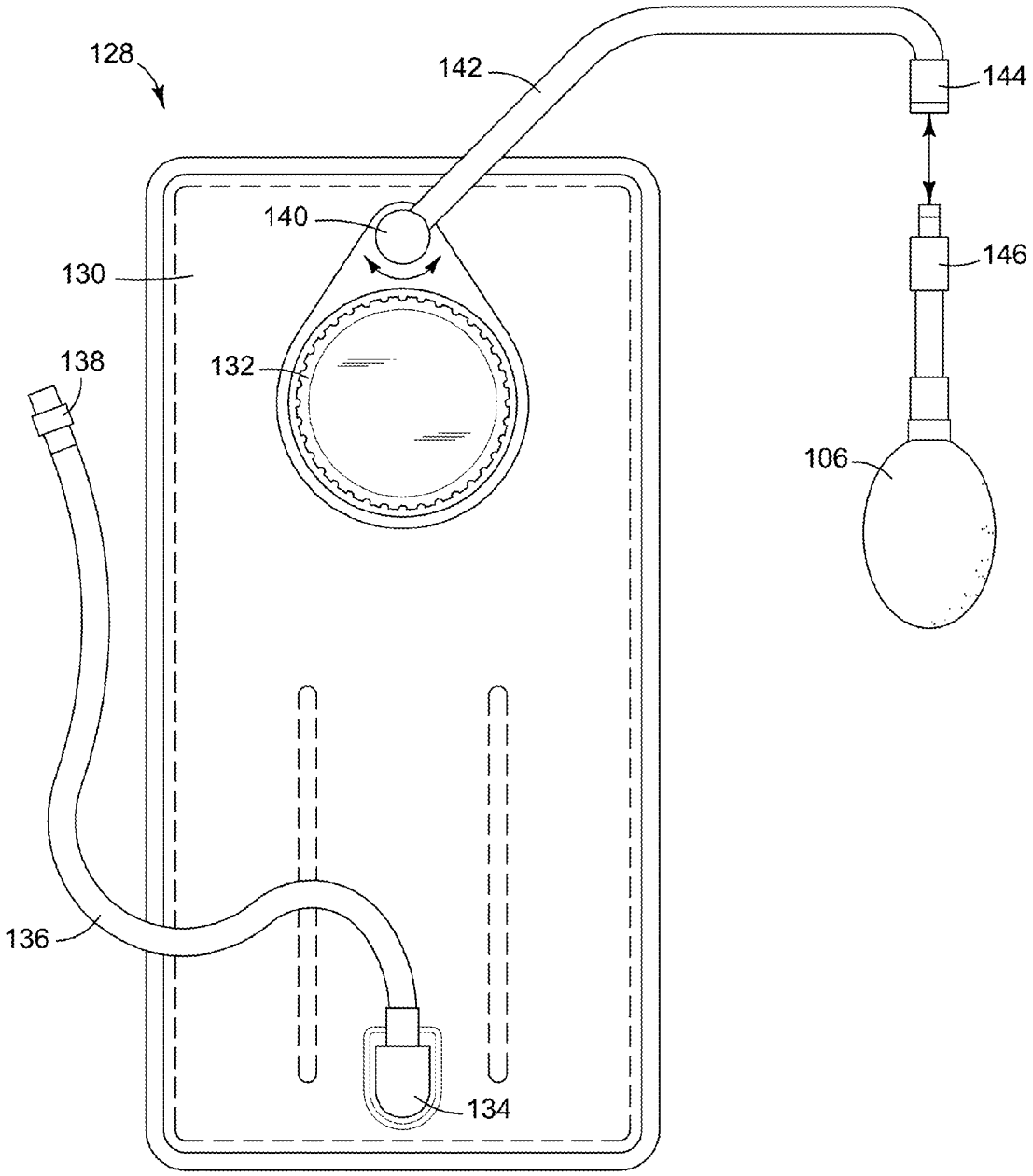

Manual Pressurization: While FIGS. 3-12 illustrate a pressurizer in the form of holder and cartridge such as holder 44 and cartridge 48. Other means for pressurizing are also contemplated. In FIGS. 13 and 14, for example, a pressurizer includes a bulb style pump such as squeeze pump 106.

Referring first to FIG. 13, reservoir 108 includes bladder 110, fill port 112, exit port 114, exit tube 116. One end of exit tube 116 is coupled to exit port 114. The other end of exit tube 116 is shown to include female coupler 118. Also shown are drinking tube 120 and squeeze pump 106. One end of drinking tube 120 includes bite valve 122 while the other end includes male coupler 124. Squeeze pump 106 include male coupler 126. Male couplers 124 and 126 are configured to be removably coupled to female coupler 118. Female coupler 118 includes a check valve (not shown) that s opened when coupled to either one of male couplers 124 or 126 allowing passage of fluids and gases through female coupler 118. When decoupled, the check valve is closed blocking the passage fluids and gases through female coupler 118.

Male coupler 126 of squeeze pump 106 can be coupled to and decoupled from female coupler 118 of exit tube 116. When coupled, the repeated manual squeezing of squeeze pump 106 forces pressurizing gas in the form of air into bladder 110 via exit tube 116. Also, male coupler 124 of drinking tube 120 can be coupled to and decoupled from female coupler 118 of exit tube 116. When coupled, fluid contained in bladder 110 is allowed to pass into and through drinking tube 120. In this example, port 114 serves as an exit port through which fluid can exit bladder 110 and as a pressure port through which pressurizing gases can enter bladder 110.

Once bladder 110 is filled with a liquid and pressurized using squeeze pump 106 and male coupler of drinking tube 124 is coupled to female coupler 118, activation of bite valve 122 results in the liquid being forced out of bladder 110 through exit tube drinking tube 38 and into a person's mouth. In this manner the person utilizing the reservoir 30 need only bite on bite valve 40 and liquid is expelled. The person need not suck to draw liquid from compartment 54.

Referring now to FIG. 14, reservoir 128 includes bladder 130, fill port 132, exit port 134, drinking tube 136, bite valve 138, swivel port 140, transfer tube 142, and female coupler 144. Also shown is squeeze pump 106 which includes male coupler 146 configured to couple to and decoupled from female coupler 144 of transfer tube 142. Female coupler 144 includes a check valve (not shown) that is opened when coupled to male coupler 146 allowing squeezed pump 106 to force pressurizing gases through transfer tube 140 and into bladder 130. When decoupled, the check valve is closed blocking the passage of fluids and gases through female coupler 144.

Swivel port 140 serves to provide an input for pressurizing gas into reservoir 128 via transfer tube 142. As its name suggests swivel port 140 swivels allowing transfer tube 142 to rotate about a point. With male coupler 146 of squeeze pump 106 coupled to female coupler 144 of transfer tube 142, the repeated manual squeezing of squeeze pump 106 forces pressurizing gases in the form of air through transfer tube 142 into bladder 130. While not shown, swivel port 140 may be integrated into fill port 132. For example, fill port 132 is shown to include a cap that closes fill port 132. Swivel port 140 could be formed in that cap such that when fill port 1322 is closed, swivel port 140 would provide input for pressurizing gases through the cap and into bladder 130.

A length of transfer tube 142 is selected to allow for convenient access to squeeze pump 106. For example squeeze pump 106 may be attached to or integrated within a shoulder strap of a backpack used to carry reservoir 128. In this manner, a person can more easily squeeze pump 106 while wearing that backpack.

Once bladder 110 is filled with a liquid and pressurized using squeeze pump 106, activation of bite valve 138 results in the liquid being forced out of bladder 130 through drinking tube 136 and into a person's mouth. In this manner the person utilizing the reservoir 128 need only bite on bite valve 138 and liquid is expelled. The person need not suck to draw liquid from bladder 130.

Removable Thermal Pack: Moving to FIG. 15, reservoir 148 is shown to include bladder 150 formed by opposing walls. As with FIGS. 7A and 7B, those walls are connected by baffles 152 and 154 within the interior compartment of bladder 150. As shown, reservoir 148 includes fill port having a collar 156 and a cap 158. Reservoir also includes an exit port 160 and, as seen in FIG. 16, a pressurization port 164.

Figure 15:
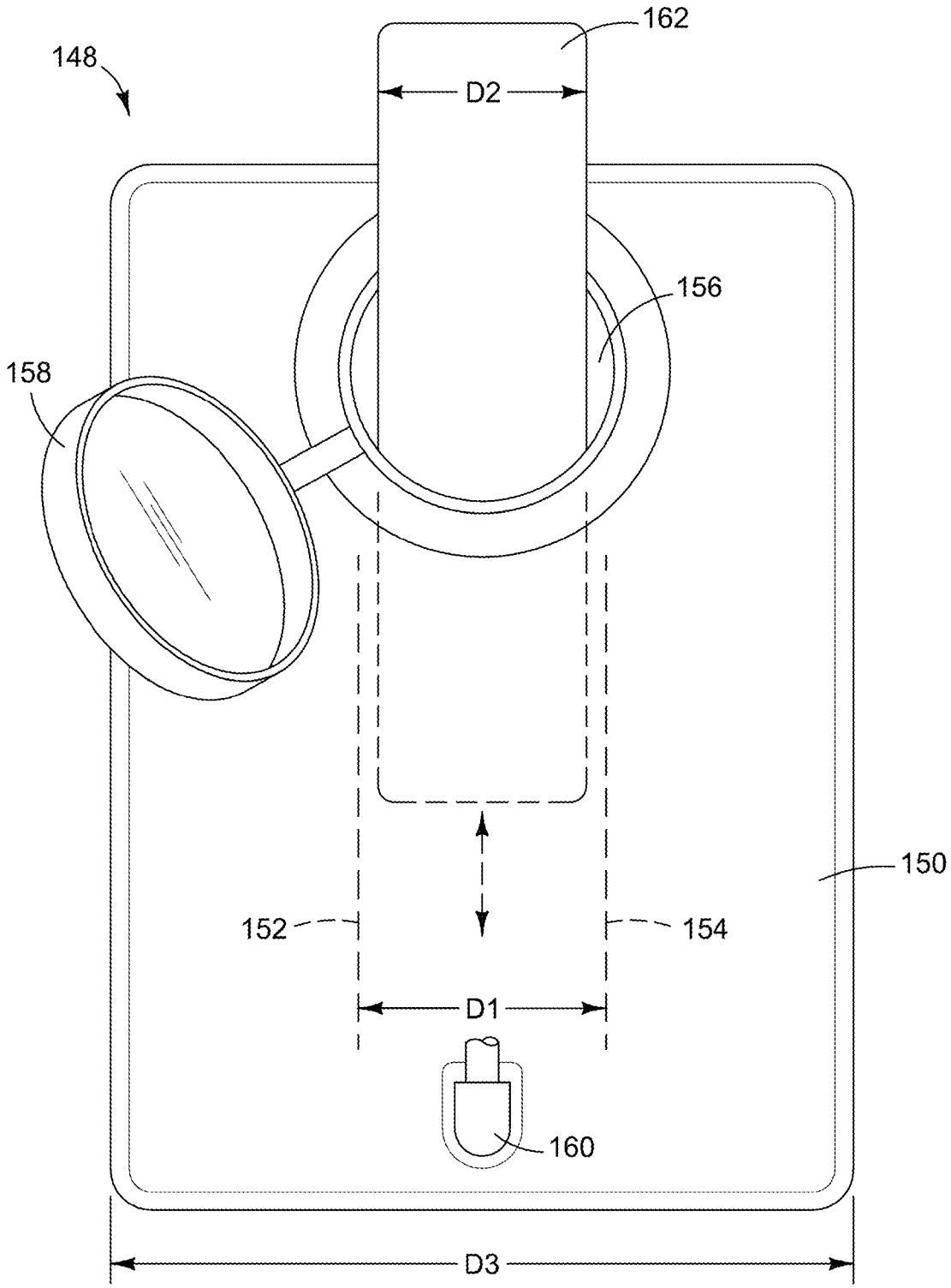
FIGS. 15-16 illustrate an exemplary implementations in which a removable thermal pack can is inserted between the baffles.
Figure 16:
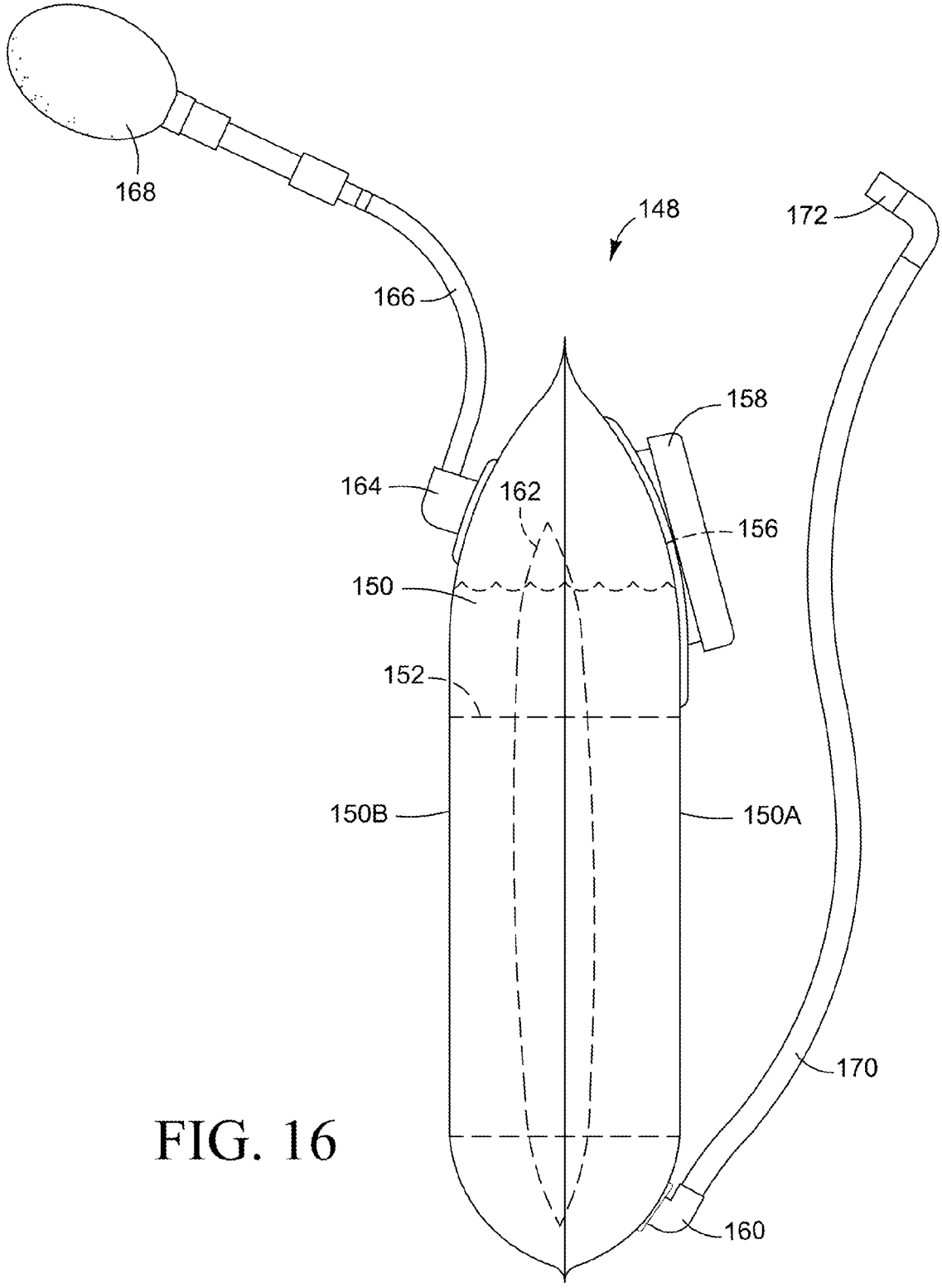

Referring still to FIG. 15, reservoir 148 includes a removable thermal pack 162. Thermal pack can be filled with a cooling and/or heating medium or a medium suitable for either application. Any such medium may be referred to as a thermal capacitance medium. The thermal capacitance medium may be water, a gel or another material, which can be repeatedly chilled and/or heated. Once its temperature is altered, the thermal capacitance medium effectively maintains fluid within bladder 150 at a depressed or an elevated temperature for some time.

As shown, baffles 152 and 154 are separated by a distance D1. Thermal pack 162 has a width dimension D2. In a given implementation D2 is generally equal to D1 allowing thermal pack to be inserted through collar 156 and wedged or positioned between baffles 152 and 154. In instances where D2 is greater than D1, inserting thermal pack 162 causes baffles 152 and 154 to stretch apart and snugly hold thermal pack in place.

As shown, baffles 152 and 154 are parallel to one another and extend along a longitudinal axis of bladder 150 whose internal compartment has an internal width dimension D3. In a given implementation, D1 is approximately one-third of D3. This ratio has proven most effective in preventing "footballing" of bladder 150 as pressurizing gases are introduced. Footballing is discussed in more detail above with respect to FIGS. 7A and 7B. In particular, selecting D1 to be approximately two inches has proven effective. The two inch dimension allows thermal pack 162 to be of sufficient volume to affectively heat or cool the contents of bladder 150. In other implementations D1 can range from 1.5 to 2.5 inches.

FIG. 16 is a left side view of reservoir 148 of FIG. 15. As shown bladder 150 has opposing walls 150A and 150B. Collar 156, and exit port 160 are positioned on wall 150A while pressurization port 164 is positioned on wall 150B. When used, reservoir may be inserted into a backpack. The positioning of pressurization port 164 on wall 150B allows transfer tube 166 to pass over one of the wearer's shoulders to provide access to squeeze bulb 168. The positioning of exit port 160 on wall 160A allows drinking tube to pass over the wearer's other shoulder to provide access to bite valve 172. In this manner, the wearer can actuate squeeze bulb 168 as desired to introduce pressurizing gases into bladder 150 without interrupting activities such as cycling, skiing, and hiking.

With reference to FIGS. 15 and 16, baffles 152 and 154 serve multiple purposes. One is to help prevent over expansion or footballing of bladder 150 when pressurized. Another is to secure thermal pack 162 preventing it from sloshing around within bladder 150 during use. Furthermore, baffles 152 and 154 secure thermal pack 162 in a generally central location within bladder 150 allowing thermal pack 162 to more efficiently heat or cool contents of bladder 150. More particularly, the central location helps to maximize the surface area of pressure pack 162 that is exposed to the contents of bladder 150.

Accessories: In the examples discussed above, each pressurized hydration system is utilized to expel a liquid from a bladder through a tube. Using couplers, examples of which are discussed above, those tubes can be removed and interchanged. Beneficially, various tubs can serve various purposes. As discussed above, a tube can be a simple drinking tube with a valve on one end and another tube can be part of a pressurizer. However, many other options are available.

Figure 17:
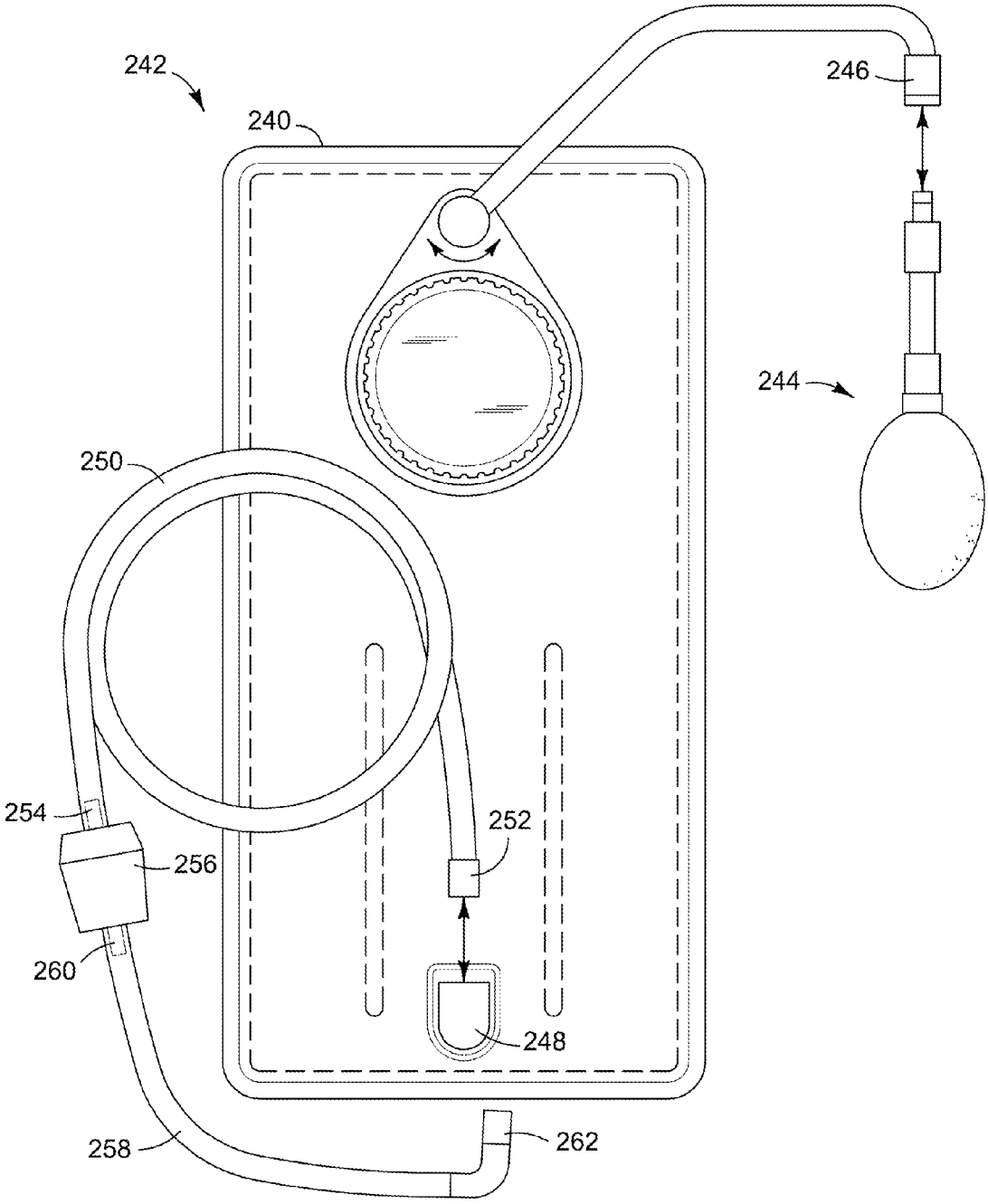
FIG. 17 illustrates an exemplary filter tube.

FIG. 17 illustrates an example of reservoir 240 and filter tube 242. Reservoir 240 includes pressurizer 244 coupleable to pressure port 246. Reservoir 240 also includes exit port 248. Filter tube 242 includes first tube 250 having a first end with a coupler 252 and a second end 254. Coupler 252 is configured to couple to exit port 248 so that a liquid held in reservoir 240 can pass through exit port 248 and into first tube 250. Filter tube 242 also included filter 256 and second tube 258. Second end of first tube 250 couples to a first port of filter 256. First end 260 of second tube 258 couples to a second port of filter 256. Second tube 258 also includes a second end with a valve 262.

The first and second ports of filter 256 are configured such that as a liquid is expelled from reservoir 240, the liquid passes through first tube 250 and through the first port and into filter 256. The liquid passes through the second port through the second tube and is ultimately expelled through valve 262. The pressure supplied by pressurizer 244 supplies the force for urging the liquid out of reservoir 240 through filter tube 242. Filter 256 is configured to remove impurities from the liquid. In this manner, reservoir 240 can be filled with water from a muddy lake, stream, or other impure source. Reservoir 240 can then be pressurized and the liquid forced through filter tube 242 to purify the water for drinking or other purposes.

Figure 18:
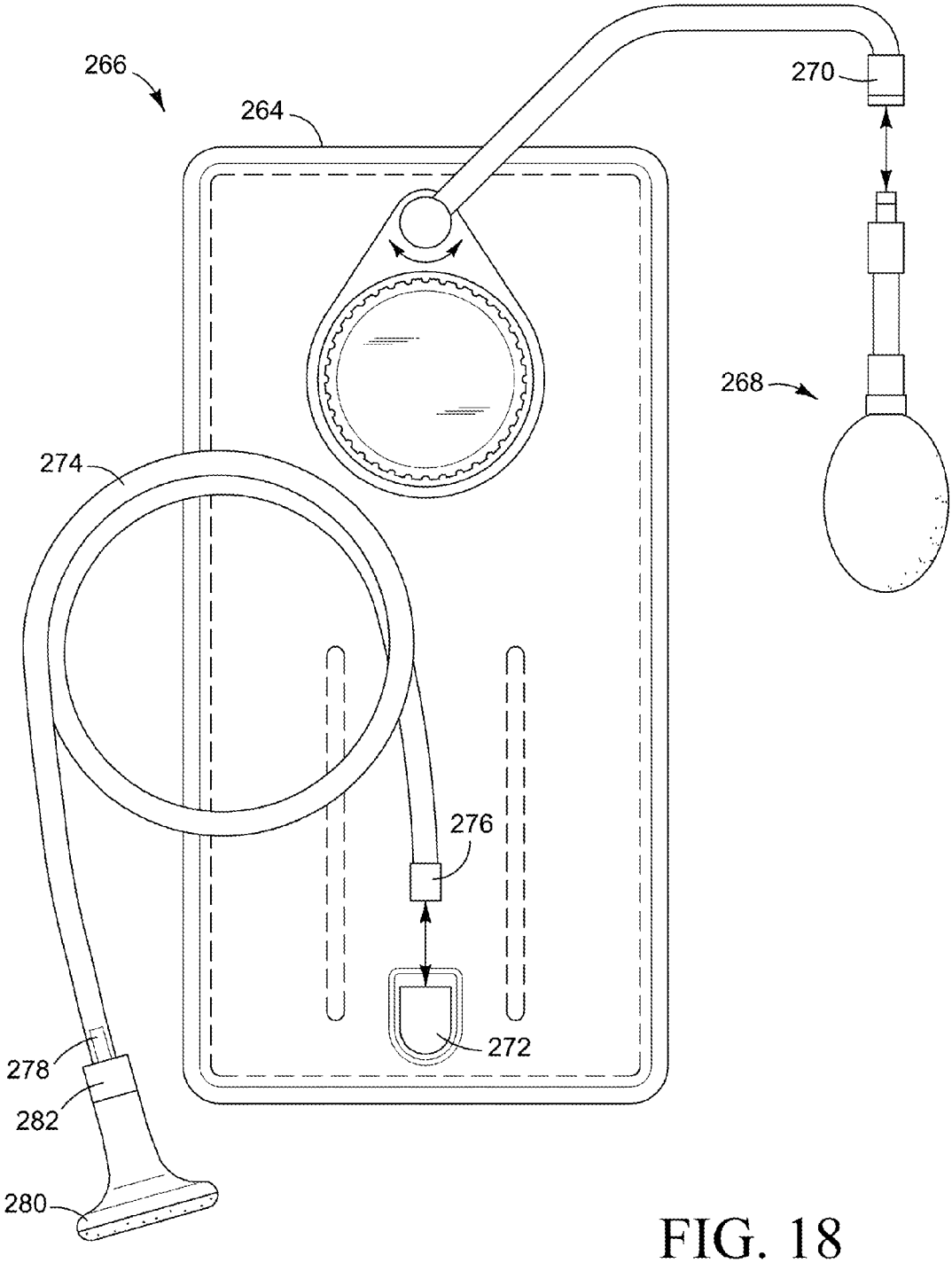
FIG. 18 illustrates an exemplary shower tube.

FIG. 18 illustrates an example of reservoir 264 and shower tube 266. Reservoir 264 includes pressurizer 268 coupleable to pressure port 270. Reservoir 264 also includes exit port 272. Shower tube 266 includes tube 274 having a first end with a coupler 276 and a second end 278. Coupler 276 is configured to couple to exit port 272 so that a liquid held in reservoir 264 can pass through exit port 272 and into tube 266. Shower tube 266 also included shower hear 280. Second end 278 of tube 274 couples to an input port of shower head 280. Shower head 280 includes shower valve 282 configured to selectively allow and block the flow of a liquid.

As a liquid is expelled from reservoir 264, the liquid passes through tube 274 and is either blocked by shower valve 282 or allowed to be sprayed by shower head 280. The pressure supplied by pressurizer 268 supplies the force for urging the liquid out of reservoir 240 through shower tube 266. Shower head 280 includes an array of holes through which the liquid flows creating a spray pattern. In this manner, reservoir 240 can be filled with water and pressurized. Valve 282 can be opened and a person can manipulate shower head 282 to direct a spray pattern to a desired location.

Conclusion: The various examples discussed above allow for the pressurization of a hydration system where that pressurization functions to more pressurized efficiently expel liquid from a reservoir. Pressurization can be achieved through a variety of techniques including the use of pressurized gas cartridges and manual bulb type pumps. The reservoir can be worn as part of a pack or even integrated into a vehicle such as a kayak. The contents of the reservoir can be cooled by a thermal capacitance medium contained in the baffles or by a removable thermal pack secured between the baffles. Furthermore, the liquid in a pressurized reservoir can be expelled through a filter, shower head, or any other useful accessory.

What is claimed is:

1. A hydration system, comprising:

first and second opposing flexible walls forming a bladder having a single sealable compartment defining an interior volume, wherein the single compartment is configured to contain both a liquid and a pressurizing gas together within the interior volume, a drinking tube having a first end with a valve and a second end;

a first port configured to receive pressurizing gas into the compartment;

a second port configured to provide fluid communication between the compartment and the drinking tube;

a third port through which the liquid can be supplied into the compartment, wherein the interior volume of the single compartment is configured to fluidly communicate with each of the first, second and third ports; and a first baffle and a second baffle connecting the first and second opposing walls within the compartment, the first and second baffles configured to oppose expansion of the bladder as the pressurizing gases are introduced into the compartment, wherein a space between the first and second baffles is accessible via the third port, the space being configured to receive and secure a thermal pack such that the thermal pack can be inserted and removed via the third port;

wherein, when sealed and pressurized, activation of the valve unseals the compartment and allows the liquid to be expelled from the compartment via the second port and the drinking tube as a result of a pressurization of the compartment by the pressurizing gas.

2. The hydration system of claim 1, further comprising the thermal pack, wherein:

the first and second baffles are parallel to one another and extend along a longitudinal axis of the bladder;

the first and second baffles are spaced apart along the longitudinal axis by a first distance; and the thermal pack has a width dimension that is substantially equal to the first distance.

3. The hydration system of claim 2, wherein the compartment has a width dimension that is substantially three times greater than the first distance.

4. The hydration system of claim 2, wherein the first distance is about two inches.

5. The hydration system of claim 2, wherein the first distance is between about 1.5 inches and about 2.5 inches.

6. The hydration system of claim 1, wherein:

the first port is formed in the first opposing wall and is configured to provide an ingress for the pressurizing gases through the first wall and into the compartment;

the second port is formed in the second opposing wall and is configured to provide an egress for the liquid to pass from the compartment through the second wall and into the drinking tube; and the third port is formed in one of the first and second opposing walls and is configured to provide an ingress for the liquid through that one of the first and second walls and into the compartment.

7. The hydration system of claim 1, further comprising a pressurizer configured to detachably couple to the first port, the pressurizer operable to supply the pressurizing gas for pressurizing the compartment when coupled to the first port.

8. The hydration system of claim 7, wherein the pressurizer includes a squeeze pump configured such that when manually squeezed, the squeeze pump expels pressurizing gas into the compartment via the first port.

9. The hydration system of claim 7, wherein the pressurizer includes a cartridge holder configured to detachable couple to the first port, the cartridge holder configured to hold and to cause a cartridge to mate with the first port allowing pressurizing gas to expel from the cartridge into the compartment via the first port.

10. The hydration system of claim 7, wherein the first port and the second port are the same port.

11. The hydration system of claim 10, wherein:

the first port includes a first coupler;

the pressurizer includes a second coupler configured to detachably couple with the first coupler; and the second end of the drinking tube includes a third coupler configured to detachably couple with the first coupler.

12. The hydration system of claim 10, wherein:

the first end of the drinking tube includes a first coupler;

the valve includes a second coupler configured to detachably couple with the first coupler; and the pressurizer includes a third coupler configured to detachably couple with the first coupler.

13. The hydration system of claim 1, wherein the drinking tube includes an inline filter configured such that when liquid is expelled from the compartment via the second port and the drinking tube as a result of a pressurization of the compartment by the pressurizing gas, the liquid is purified by the filter before being expelled from the valve.

14. The hydration system of claim 1, wherein the second end of the drinking tube includes a first coupler configured to detachably couple to the second port, the hydration system further comprising a shower tube, the shower tube including a first end with a shower head, a shower valve, and a second end with a second coupler configured to detachably couple to the second port so that upon activation of the shower valve the liquid can be expelled from the compartment via the second port and spray through the shower head as a result of a pressurization of the compartment by the pressurizing gas.

15. The hydration system of claim 1, wherein the first baffle comprises opposing panels connecting the first and second opposing flexible walls of the bladder, wherein the opposing panels form a sealed baffle pocket configured to receive a thermal capacitance medium.

* * * * *